US005860222A

United States Patent [19]

Leander

[11] Patent Number: 5,860,222

[45] Date of Patent: Jan. 19, 1999

[54] SEMIAUTOMATIC FEEDER LINE PARTICULARLY FOR SETTING OUT/DRY MACHINES VACUUM-DRIERS, AND STAKERS FOR INDUSTRIAL HIDES

[75] Inventor: Veeger Leander, LG Breda, Netherlands

[73] Assignee: Officine di Cartigliano S.p.A., Cartigliano, Italy

[21] Appl. No.: 836,193

[22] PCT Filed: Nov. 14, 1995

[86] PCT No.: PCT/EP95/04471

§ 371 Date: May 12, 1997

§ 102(e) Date: May 12, 1997

[87] PCT Pub. No.: WO96/15275

PCT Pub. Date: May 23, 1996

[30] Foreign Application Priority Data

Nov. 15, 1994 [IT] Italy ..... VI94A0167

[51] Int. Cl.[6] ..... F26B 13/30

[52] U.S. Cl. ..... 34/92

[58] Field of Search ..... 34/90, 92, 614, 34/615, 619, 621, 635; 38/143; 414/222; 427/176, 209, 381; 198/341, 463.3, 465.1

[56] References Cited

U.S. PATENT DOCUMENTS 5,033,206 7/1991 Corner ..... 34/92

5,056,239 10/1991 Corner ..... 34/92

5,129,162 7/1992 Hemmersbach et al. ..... 34/92 X 5,421,686 6/1995 Covert et al. ..... 34/92 X

*Primary Examiner*—Henry A. Bennett

*Assistant Examiner*—Steve Gravini

*Attorney, Agent, or Firm*—R. Neil Sudol; Henry D. Coleman

[57] ABSTRACT

A line for the semiautomatic feeding of industrial hides, particularly for setting-out/drying machines and vacuum driers, includes a loading/unloading device (5, 5') that lies between the unloading section of the setting-out/drying machine (2) and the drying tables (3') of the vacuum drier (3); the device (5, 5') can be actuated on command after spreading the hides (P, P') on each table of the vacuum drier. The loading/unloading device (5, 5') has at least one movable surface (8, 8') and has a translatory direction (V) that lies substantially at right angles to the main dimension of the tables (8) of the vacuum drier (3). The loading/unloading device (5, 5') is of the type with a movable conveyor belt (6) with an unloading end (7) that can be superimposed on the tables of the vacuum drier (3). It is possible to provide a conveyor belt (12) that is interposed between the vacuum drier (3) and an optional percher (4) that is aligned with it.

8 Claims, 2 Drawing Sheets

SEMIAUTOMATIC FEEDER LINE PARTICULARLY FOR SETTING OUT/DRY MACHINES VACUUM-DRIERS, AND STAKERS FOR INDUSTRIAL HIDES

The present invention relates to a semiautomatic feeder line particularly for setting-out/drying machines, vacuum-driers, and optionally stakers for industrial hides.

It is known that hides that are wet after tanning or dyeing processes are sammed and set-out by means of a samming/setting-out machine and are then dried by means of a vacuum driers to eliminate residual moisture almost entirely. Finally, they are stretched in a staker to regain their original softness and to increase their surface.

In the first samming/setting-out step, normal production with two operators is approximately 40÷50 hides per hour. In the second vacuum drying step, production with two operators is approximately 10 hides per hour. The third staking step allows to provide an hourly production rate that is higher than the above mentioned values even with a single operator.

Accordingly, approximately 20–22 operators, with considerable idle times, are required in order to achieve a production of approximately 100 hides per hour. Furthermore, the transfer of the hides between the three above mentioned machines requires the use of beams that must be transferred from one machine to the other, with considerable wastes of time, energy, and labor.

The aim of the invention is to reduce the above mentioned drawbacks, providing a feeder line for setting-out/drying machines, vacuum driers, and optionally stakers of the substantially automatic type that allows to limit the use of labor and increase the productivity of the apparatus.

A particular object is to provide a system for the direct and semiautomatic transfer of the hides between the various units of the apparatus, eliminating idle times, caused by the unloading and loading of the hides on a means for picking up the hides and transferring them from one machine to the next, as well as reducing the assigned personnel and the required energy.

Another object is to provide a semiautomatic line of the above mentioned type that has reduced dimensions and allows to optimize space and to use complete facilities even in small tanneries.

This aim, these objects, and others which will become apparent hereinafter are achieved by a semiautomatic feeder line of the type defined in the introduction, which has the characteristics stated in the accompanying claim 1.

By means of a feeder line according to the invention, considerable time can be saved and therefore high productivity of the apparatus is achieved. The use and fatigue of assigned personnel is reduced and the space required for apparatus management is reduced to a minimum.

Further characteristics and advantages will become apparent from the detailed description of some preferred but not exclusive embodiments of the invention, given by way of non-limitative example with the aid of the accompanying drawings, wherein.

Figure 1:
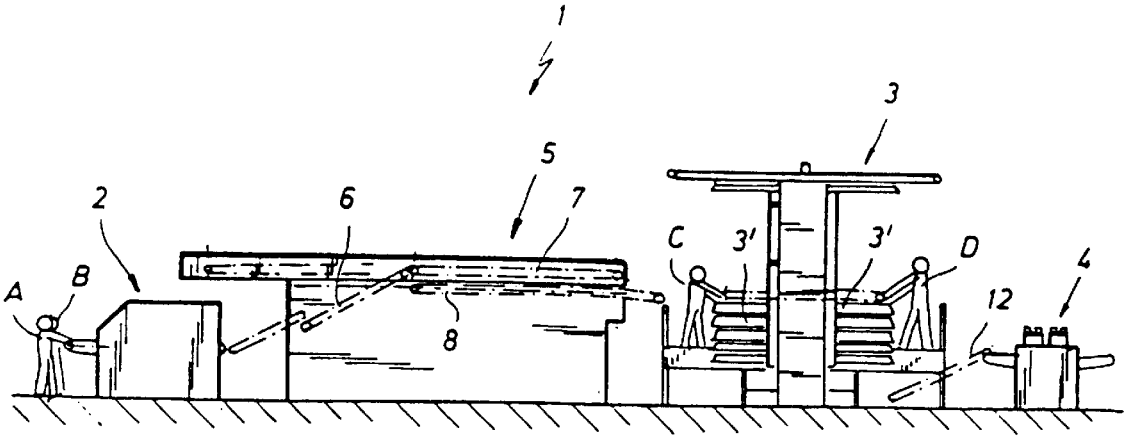
FIG. 1 is a side view of a first embodiment of the semiautomatic apparatus according to the invention.
Figure 2:
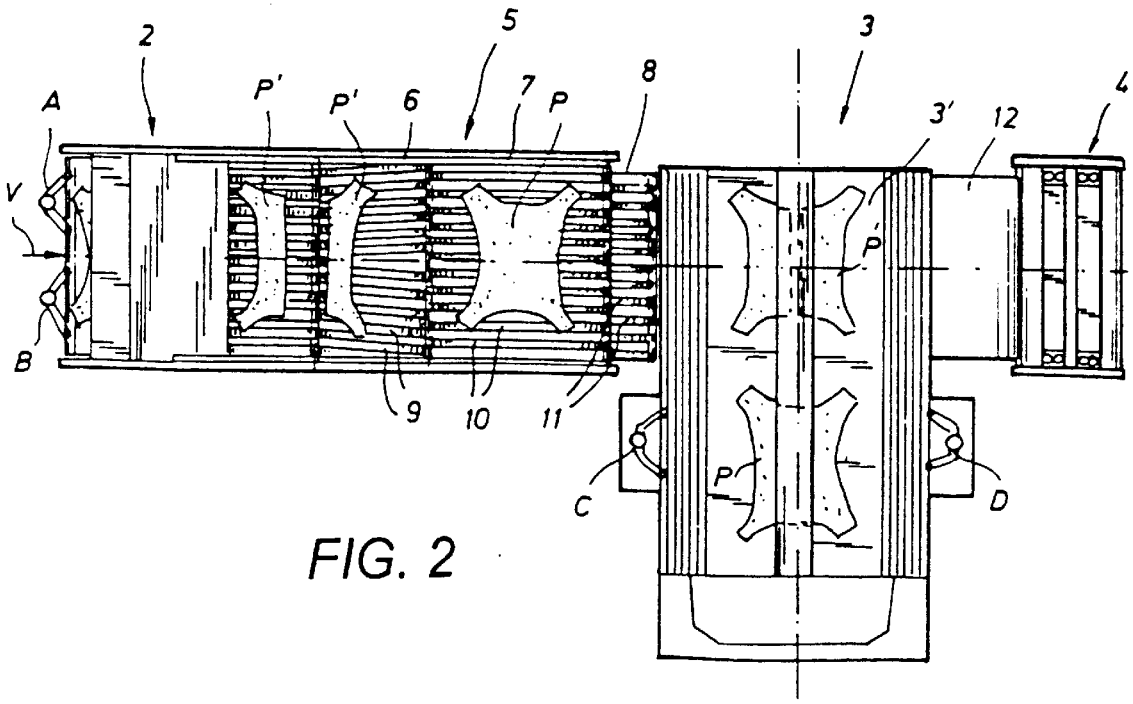
FIG. 2 is a top view of the apparatus of FIG. 1.

With reference to FIGS. 1 and 2, the semiautomatic line according to the invention, generally designated by the reference numeral 1, has the purpose of transferring whole or half industrial bovine hides P or P' from a first continuous samming/setting-out machine 2 to a vacuum drier 3 with multiple tables and optionally to a staker 4 with beating plates.

By way of non-limitative example, the samming/setting-out machine can be the continuous-cycle model manufactured and marketed by the Bauce company of Trissino, Vicenza (Italy), under the name PRC4 RA 3200, whereas the vacuum drier 3 can be of the type with 5–6 working tables 3', manufactured and marketed by the Cartigliano company of Cartigliano, Vicenza (Italy). The staker 4 can be the Syncro 3200 model, also manufactured and marketed by the Cartigliano company.

According to the invention, the machines 2 and 3 are appropriately arranged in adjacent positions and are connected by a loading/unloading device 5 that runs from the output section of the machine 2 to the drying tables of the drier 3.

In particular, the loading/unloading device 5 includes a supporting structure that supports a fixed inclined surface 6, a movable upper surface 7 arranged above a movable lower surface 8, which lie along a direction V that lies substantially at right angles to the longer dimension of the tables 3' of the vacuum drier, which have a substantially rectangular shape.

The first fixed surface 6 is preferably formed by two rows of annular bands 9 that are symmetrical with respect to the centerline and diverge slightly to spread the hides during advancement.

The two movable portions 7 and 8 are formed by respective series of annular belts 10, 11 that are stretched by end tensioning rollers and are approximately as wide as half the longer dimension of the tables 3.

The upper surface 7 is mounted on a truck which is movable with respect to the supporting structure along the same direction V to unload the hides P, P' onto the movable lower surface 8.

The movable lower surface 8 is mounted on an additional truck that can move with respect to the supporting structure along the direction V to transfer the hides P, P' onto one half of the tables 3'.

It is noted that the translatory direction V of the movable lower surface 8 lies at right angles to the longer dimension of the tables 3' of the drier 3, as shown in dashed lines in FIG. 2.

Optionally, a belt conveyor 12 may be arranged after the vacuum drier 3, for transferring the hides to the staker 4.

During use, two operators A and B insert the separated or superimposed hides P or P' in the machine 2, for samming and setting out, reducing residual moisture to approximately 50% of the total.

The two operators C and D that are located on the lateral platforms of the machine 3 actuate the device 5 to transfer the hides P, P' that are accumulated on the movable lower surface 8 onto the table. Then they can pick up and spread the hides, distributing them easily and quickly on the table 3'.

In optimum conditions, drying with the vacuum drier will allow to reduce residual moisture to approximately 7%.

Assuming that the spreading time for each individual hide is approximately 20 seconds and that the drying time is approximately 4–6 minutes, it is possible to calculate a theoretical hourly capacity of approximately 100 hides with only four operators, two working at the machine 2 and two working at the drier 3, considerably increasing the productivity of the apparatus.

Furthermore, the energy required to transport the beams and lift trucks will be reduced, and the continuous operation of the machines will be optimized, considerably reducing the footprint of the line.

Figure 3:
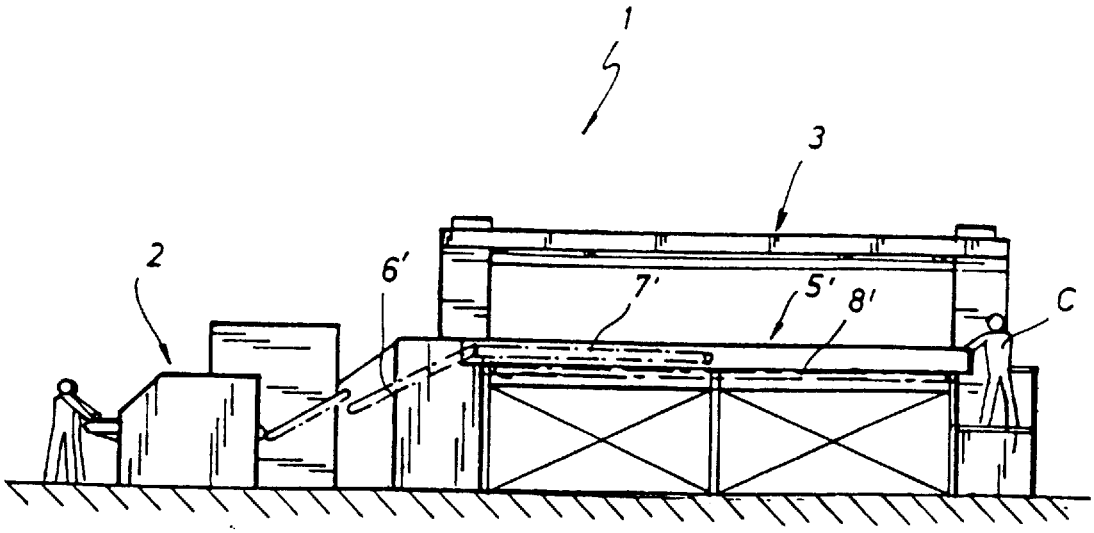
FIG. 3 is a side view of a second embodiment of the semiautomatic apparatus according to the invention.
Figure 4:
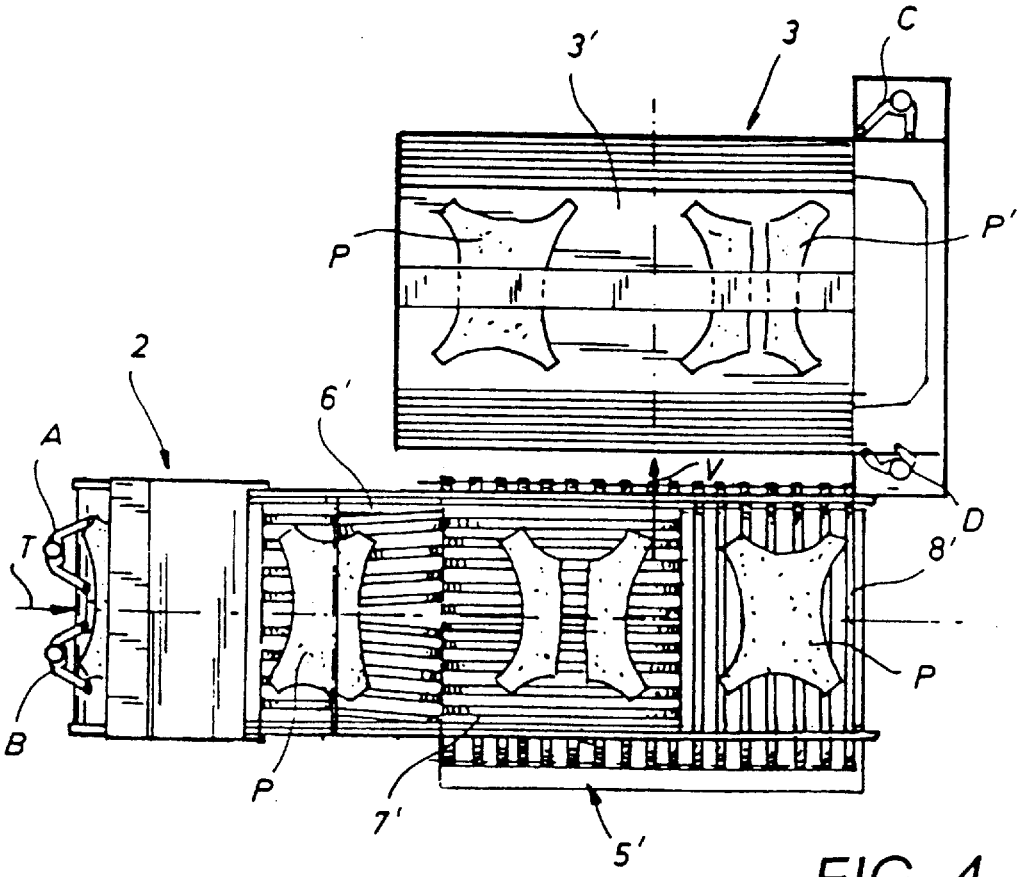
FIG. 4 is a top view of the apparatus of FIG. 3.

The embodiment shown in FIGS. 3 and 4 differs from the preceding one due to some structural characteristics of the loading/unloading device 5' and its relative position with respect to the vacuum drier 3.

The fixed inclined surface 6' and the movable upper one 7' have an advancement and translatory direction T that is substantially parallel with respect to the longer dimension of the tables 3' of the drier 3.

The lower surface 8' is substantially as wide as the longer dimension of the tables 3', and is mounted on a truck that can move along a direction V that lies at right angles to the direction T and to the longer dimension of the tables 3'.

In this case, the second surface 7' moves to the right or to the left in FIG. 4 to unload the hides P, P' onto the two halves of the underlying surface 8', and the underlying surface moves along the direction T to deposit the hides P, P' onto the tables 3' of the drier 3.

During use, two operators A and B can insert in the machine 2 the hides to be stentered and dried partially. These hides are transferred from the inclined surface 6' of the device 5' onto the movable surface 7', and from there onto the lower movable surface 8'. The two operators C and D that are assigned to the drier 3 can activate the translatory motion of the movable lower surface 8', so as to unload the hides P, P' directly onto the two facing halves of the tables 3', then they spread them accurately before starting the drying cycle.

The machine according to the invention is susceptible of numerous modifications and variations, all of which are within the protective scope defined in the accompanying claims. All the details may be replaced with technically equivalent elements; the materials may be different according to the requirements.

I claim:

1. A line for the semiautomatic feeding of industrial hides, particularly for samming/setting-out machines, vacuum driers, with multiple drying tables and optionally stakers, comprising a loading/unloading device actuatable on command to spread hides on each drying table of a vacuum drier, wherein said loading/unloading device is located between an unloading section of a samming/setting-out machine and the drying tables of the vacuum drier, and wherein said loading/unloading device comprises at least a fixed transporting surface extending from an output section of said samming/setting-out machine, at least an upper movable surface adjacent to said fixed transporting surface and at least a lower movable surface arranged below said upper movable surface and extending up to the drying tables of said vacuum drier.

2. Line according to claim 1, wherein said fixed surface is inclined with respect to said upper movable surface.

3. Line according to claim 2, wherein said upper movable surface and said lower movable surface are mutually parallel and substantially horizontal.

4. Line according to claim 3, wherein said fixed surface and said movable upper surface have a translatory direction that is substantially parallel to a translatory direction of said movable lower surface.

5. Line according to claim 3, wherein said fixed surface and said movable upper surface have a translatory direction that is substantially perpendicular to a translatory direction of said movable lower surface.

6. Line according to claim 1, wherein said fixed and said movable surfaces are formed by series of annular bands that are stretched by tensioning rollers and are mutally transversely offset.

7. Line according to claim 6, wherein said fixed surface is formed by two sets of annular bands that are slightly diverging with respect to a centerline of the surfaces to spread the hides.

8. Line according to claim 1, further comprising a conveyor that is interposed between said vacuum drier and an optional staker that is arranged downstream of said vacuum drier.

* * * * *